US010016691B2

(12) United States Patent
Tong et al.

(10) Patent No.: US 10,016,691 B2
(45) Date of Patent: Jul. 10, 2018

(54) WATER BUCKET GAMES, SYSTEMS, AND METHODS

(71) Applicant: POLYGROUP MACAU LIMITED (BVI), Road Town, Tortola (VG)

(72) Inventors: Ricky Tong, Shenzhen (CN); Victor Hugo Ocegueda Gallaga, Baja California (MX)

(73) Assignee: POLYGROUP MACAU LIMITED (BVI), Road Town, Tortola (VG)

( * ) Notice: Subject to any disclaimer, the term of this patent is extended or adjusted under 35 U.S.C. 154(b) by 0 days.

(21) Appl. No.: 15/233,441

(22) Filed: Aug. 10, 2016

(65) Prior Publication Data

US 2017/0043266 A1 Feb. 16, 2017

Related U.S. Application Data

(60) Provisional application No. 62/203,443, filed on Aug. 11, 2015.

(51) Int. Cl.

| | |
|---|---|
| ***A63B 9/00*** | (2006.01) |
| ***A63G 31/00*** | (2006.01) |
| *A63H 23/00* | (2006.01) |
| *E04H 4/14* | (2006.01) |

(52) U.S. Cl.

CPC ..... *A63G 31/007* (2013.01); *E04H 4/14* (2013.01)

(58) Field of Classification Search

CPC ..... A63B 9/00; A63G 21/00; A63G 21/16; A63G 21/18; A01G 25/00; A01G 25/14; B65D 88/56

USPC ..... 472/13, 116, 117, 128, 129; 104/69, 70; 239/377

See application file for complete search history.

(56) References Cited

U.S. PATENT DOCUMENTS

| | | | | | |
|---|---|---|---|---|---|
| 2,919,948 | A * | 1/1960 | Williams | B65D 88/56 | 294/68.26 |
| 3,787,063 | A * | 1/1974 | Oliver | B62B 3/182 | 186/52 |
| 5,194,048 | A * | 3/1993 | Briggs | A63B 9/00 | 472/128 |
| 5,820,471 | A * | 10/1998 | Briggs | A63B 9/00 | 472/117 |
| 5,839,964 | A * | 11/1998 | Rudell | A63B 9/00 | 472/117 |
| 6,342,016 | B1 * | 1/2002 | Parker | A63G 31/16 | 472/117 |
| 2010/0025496 | A1 * | 2/2010 | Fitzsimons | A01G 25/14 | 239/377 |

* cited by examiner

*Primary Examiner* — Kien Nguyen
(74) *Attorney, Agent, or Firm* — Troutman Sanders LLP; Ryan A. Schneider; Christopher C. Close, Jr.

(57) ABSTRACT

The disclosed technology includes an apparatus for a water bucket game. The water bucket game may fill a suspended container with water until the force of the water causes the container to rotate and empty onto pool-goers below. The extent of the rotation may be limited by a stopper positioned within a recess of the container. The water bucket may be configured such that the water bucket returns to an upright position after the bucket empties the water.

18 Claims, 4 Drawing Sheets

WATER BUCKET GAMES, SYSTEMS, AND METHODS

CROSS REFERENCE TO RELATED APPLICATION

This application claims the benefit, under 35 U.S.C. § 119(e), of U.S. Provisional Patent Application No. 62/203,443 filed Aug. 11, 2015, entitled "WATER BUCKET GAMES, SYSTEMS, AND METHODS," the entire contents and substance of which is incorporated herein by reference in its entirety as if fully set forth below.

TECHNICAL FIELD

Aspects of the present disclosure relate to apparatuses for amusement and, more particularly, to a water bucket game.

BACKGROUND

Swimming pools are popular sources of relaxation and entertainment. Although submersion in a pool is often a refreshing and a desirable way to stay cool in hot climates, typically people do not prefer to remain fully submerged in a pool for long periods of time. Thus, portions of their bodies that remain above the surface of the water may become uncomfortably hot. For this reason, pool toys, such as water guns, that can propel water at a person, are a popular way to have fun in a swimming pool and also cool down exposed body parts.

BRIEF DESCRIPTION OF THE FIGURES

Reference will now be made to the accompanying figures, which are not necessarily drawn to scale, and wherein.

DETAILED DESCRIPTION

Figure 1:
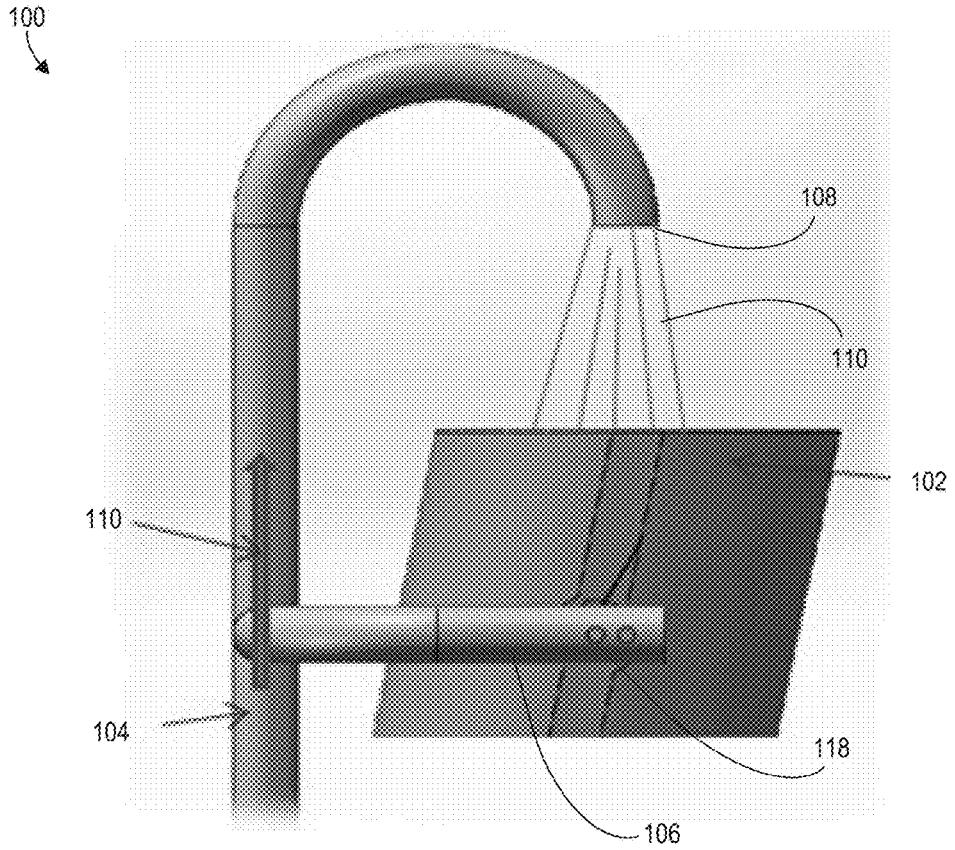
FIG. 1 is a side view of a water bucket game, in accordance with an example embodiment of the presently disclosed subject matter.

The present disclosure can be understood more readily by reference to the following detailed description of exemplary embodiments and the examples included herein. Before the exemplary embodiments of the devices and methods according to the present disclosure are disclosed and described, it is to be understood that embodiments are not limited to those described within this disclosure. Numerous modifications and variations therein will be apparent to those skilled in the art and remain within the scope of the disclosure. It is also to be understood that the terminology used herein is for the purpose of describing specific embodiments only and is not intended to be limiting. Some embodiments of the disclosed technology will be described more fully hereinafter with reference to the accompanying drawings. This disclosed technology may, however, be embodied in many different forms and should not be construed as limited to the embodiments set forth therein.

In the following description, numerous specific details are set forth. However, it is to be understood that embodiments of the disclosed technology may be practiced without these specific details. In other instances, well-known methods, structures, and techniques have not been shown in detail in order not to obscure an understanding of this description. References to "one embodiment," "an embodiment," "example embodiment," "some embodiments," "certain embodiments," "various embodiments," etc., indicate that the embodiment(s) of the disclosed technology so described may include a particular feature, structure, or characteristic, but not every embodiment necessarily includes the particular feature, structure, or characteristic. Further, repeated use of the phrase "in one embodiment" does not necessarily refer to the same embodiment, although it may.

Unless otherwise noted, the terms used herein are to be understood according to conventional usage by those of ordinary skill in the relevant art. In addition to any definitions of terms provided below, it is to be understood that as used in the specification and in the claims, "a" or "an" can mean one or more, depending upon the context in which it is used. Throughout the specification and the claims, the following terms take at least the meanings explicitly associated herein, unless the context clearly dictates otherwise. The term "or" is intended to mean an inclusive "or." Further, the terms "a," "an," and "the" are intended to mean one or more unless specified otherwise or clear from the context to be directed to a singular form.

Unless otherwise specified, the use of the ordinal adjectives "first," "second," "third," etc., to describe a common object, merely indicate that different instances of like objects are being referred to, and are not intended to imply that the objects so described must be in a given sequence, either temporally, spatially, in ranking, or in any other manner.

Also, in describing the exemplary embodiments, terminology will be resorted to for the sake of clarity. It is intended that each term contemplates its broadest meaning as understood by those skilled in the art and includes all technical equivalents that operate in a similar manner to accomplish a similar purpose.

To facilitate an understanding of the principles and features of the embodiments of the present disclosure, exemplary embodiments are explained hereinafter with reference to their implementation in an illustrative embodiment. Such illustrative embodiments are not, however, intended to be limiting.

The materials described hereinafter as making up the various elements of the embodiments of the present disclosure are intended to be illustrative and not restrictive. Many suitable materials that would perform the same or a similar function as the materials described herein are intended to be embraced within the scope of the exemplary embodiments. Such other materials not described herein can include, but are not limited to, materials that are developed after the time of the development of the invention, for example.

Embodiments of the disclosed technology include a water bucket game for providing entertainment. In various embodiments, a water bucket game may dispense water at various intervals. For example, a water bucket game can dispense water onto one or more people in a pool ("poolgoers"). Although this disclosure describes use of a water bucket game in association with a swimming pool or by pool-goers, it will be understood by those of skill in the art that the water bucket game may be utilized in a variety of environments. The water bucket game may provide entertainment by creating a degree of anticipation, uncertainty and excitement in the minds of the pool-goers with respect to when the water will dispense. The water bucket game may also serve to provide refreshment to the pool-goers by releasing water on them to cool them off in hot weather.

Referring now to the drawings, FIG. 1 illustrates an example embodiment of a water bucket game 100. In one embodiment, a water bucket game may comprise a container 102, a base member 104 and a support member 106. In some embodiments, the container 102 may be a hollow, substantially cylindrical shape, having a bottom on one end and an open mouth opposite the bottom on the other end with a sidewall disposed in between. For example, in some embodiments, the container 102 may be a bucket (and may be referred to as such). In some embodiments, the shape of container 102 may be such that the sidewall is not perpendicular to the bottom of the container 102 (i.e., the sidewall is skewed relative to the bottom of the container), as shown in the example in FIG. 1.

According to some embodiments, the base member 104 may be configured to be in contact with the ground and may support the entire weight of the water bucket game 100. In some embodiments, the water bucket game 100 may be a freestanding structure, with the base member 104 configured to rest on the ground. In some embodiments, the base member 104 may be configured to attach to the side of another structure, for example, to the side of an above-ground pool.

In some embodiments, the base member 104 can be a tube configured to facilitate the movement of a fluid 110, such as water. For example, the base member may be a hollow pipe, made out of PVC, copper, metal, or any other suitable material. According to some embodiments, the base member 104 may be capable of housing a hose, such that fluid 110 enters a first end of the base member 104 and exits a second end 108 of the base member 104. In some embodiment, a hose may connect to a first end of the base member 104, by, for example, screwing together. In some embodiments, the hose connected to the first end of the base member 104 may couple to a hose or pipe which is internal to the base member 104.

In some embodiments, a hose may be inserted into a first end of the base member 104 such that it runs through a portion or the entire length of the base member 104. According to some embodiments, a portion of the base member 104 may be orientated substantially vertically to the ground. For example, a vertical portion of a base member 104 may be configured to vertically extend away from a first end of the base member 104. A vertical portion of a base member 104 may extend a distance above the ground, or a distance above the edge of an above ground pool. In some embodiments, a rounded portion of a base member 104 may extend away from the upper end of the vertical portion of the base member 104, forming an inverted U-shape as shown in FIG. 1. The rounded portion of the base member 104 may terminate in the second end 108. According to some embodiments, the second end 108 may provide an opening of the base member 104 through which fluid 110 may be expelled.

According to some embodiments, a support member 106 may be attached to the base member 104. In some embodiments, the support member 106 may extend substantially horizontally away from a vertical portion of the base member 104, as shown in FIG. 1. The support member 106 may be configured to suspend a container 102. In some embodiments, the support member 106 may have two substantially parallel arms that attach to opposite sides of the container 102, at for example, a first attachment point 118 and a second attachment point 118. In some embodiments, the support member 106 may attach to the container 102 by one or more pole members, such as one or more pins. According to some embodiments, the container 102 may be attached to the support member 106 such that it is configured to rotate about an axis that runs substantially from the first attachment point 118 to the second attachment point 118. According to some embodiments, the attachment points 118 may be positioned approximately in the center of the length of the container 102. In some embodiments, the attachment points 118 may be positioned at a location that is offset from the center of the length of the container 102. According to some embodiments, the container 102 may be configured to rotate freely 360 degrees about an axis. As described in further detail below, in some embodiments, the rotation of the container 102 may be restricted to a predetermined range of angles. For example, in some embodiments the container 102 may be restricted to a rotation of 90 degrees, 135 degrees, or 180 degrees or varying amounts there between. It will be appreciated by those of skill in the art that the rotation of the container 102 may be designed to be restricted to any number of degrees (less than 360 degrees).

As shown in FIG. 1, the water bucket game 100 may be configured to receive and then transport fluid 110 up through base member 104, and the fluid 110 may be expelled out of the second end 108 of the base member 104 where it may be received by container 102. In some embodiments, fluid 110, such as water, may be received from, for example, a hose connected to a conventional house faucet that is pumped into the first end of the base member 104. In some embodiments, the water game 100 may include a pump that can pump fluid 110 out of a swimming pool or other water source into the first end of the base member 104.

Figure 2A:
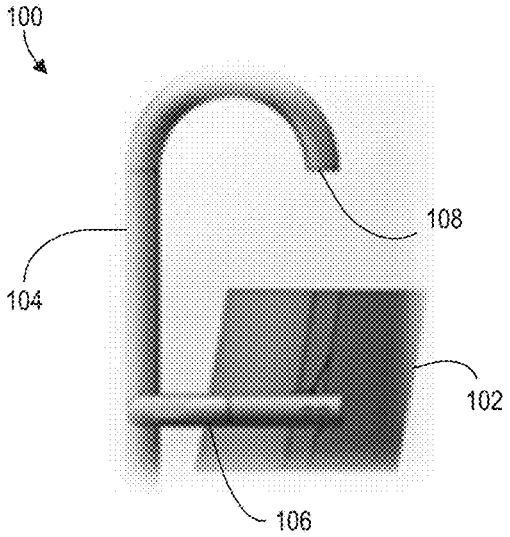
FIG. 2A is a side view of a water bucket game in a first position, in accordance with an example embodiment of the presently disclosed subject matter.
Figure 2B:
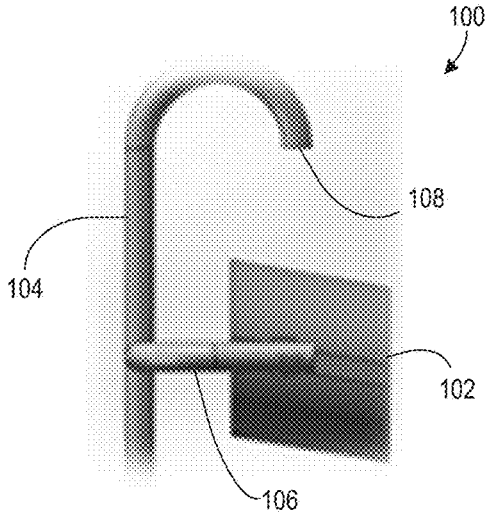
FIG. 2B is a side view of a water bucket game in a second position, in accordance with an example embodiment of the presently disclosed subject matter.

As shown in FIGS. 2A-B, the water bucket game 100 may have two states—a first beginning (or neutral) position and a second pouring (or emptying) position. According to some embodiments, in the beginning position, the container 102 may be positioned upright, orientated with the mouth of the container 102 facing upwards towards the second end 108 of the support member 106. As fluid 110 is expelled from the second end 108 of the support member 106 and is received by container 102, the container 102 may begin to fill up with fluid 110. According to some embodiments, the container 102 may rotate and enter a pouring position upon filling up to a predetermined level. According to some embodiments, when entering the pouring position, the container 102 may rotate such that the mouth of the container 102 is orientated to a position facing opposite to a vertical portion of the base member 104. In some embodiments the container 102 may continue to rotate until the mouth of the container 102 is facing substantially downwards. In some embodiments, as the container 102 rotates into the pouring position, the fluid 110 contained within the container 102 may spill out into, for example, a swimming pool.

Figure 3A:
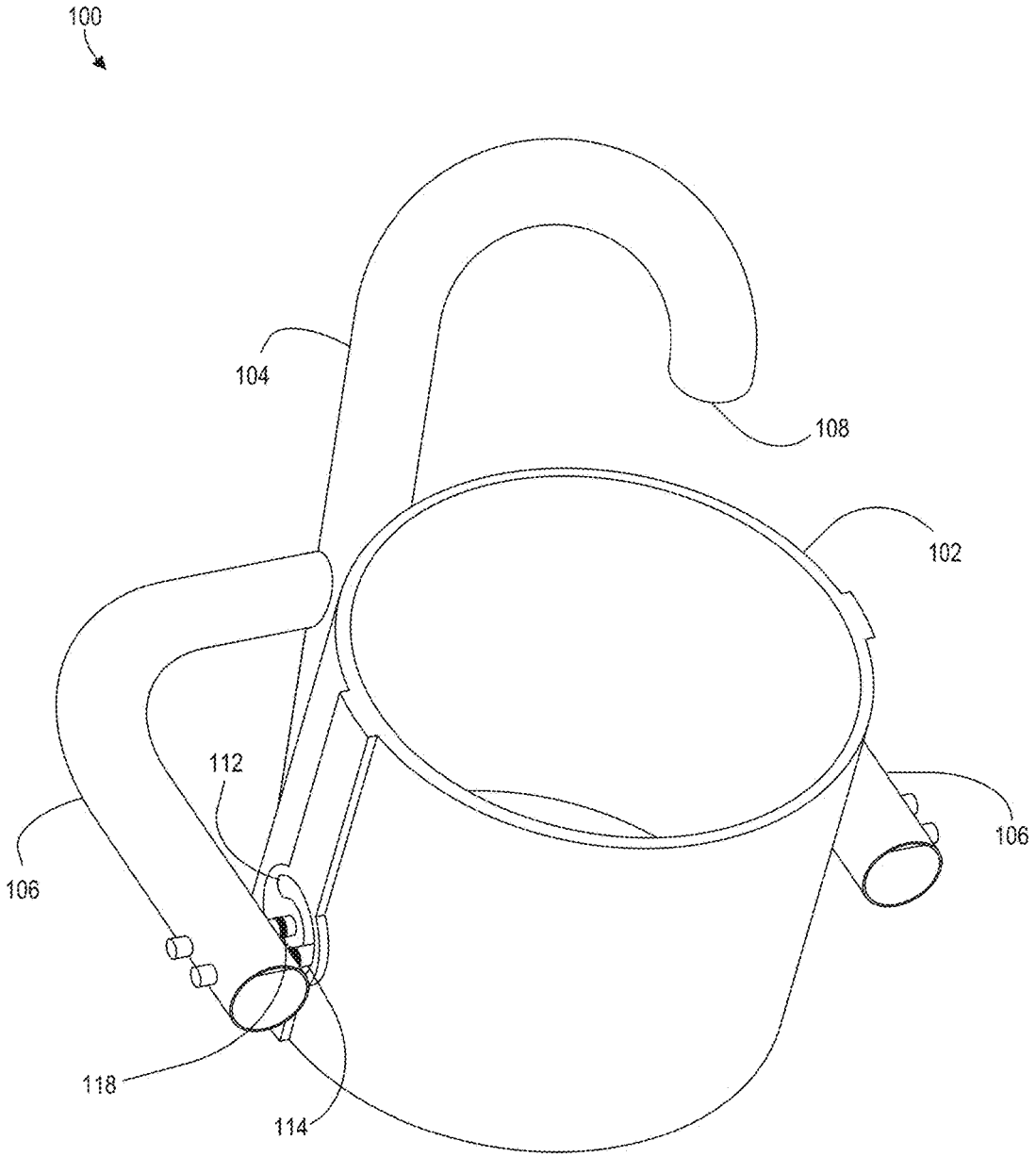
FIG. 3A is a partial perspective view of a water bucket game in a first position, in accordance with an example embodiment of the presently disclosed subject matter.
Figure 3B:
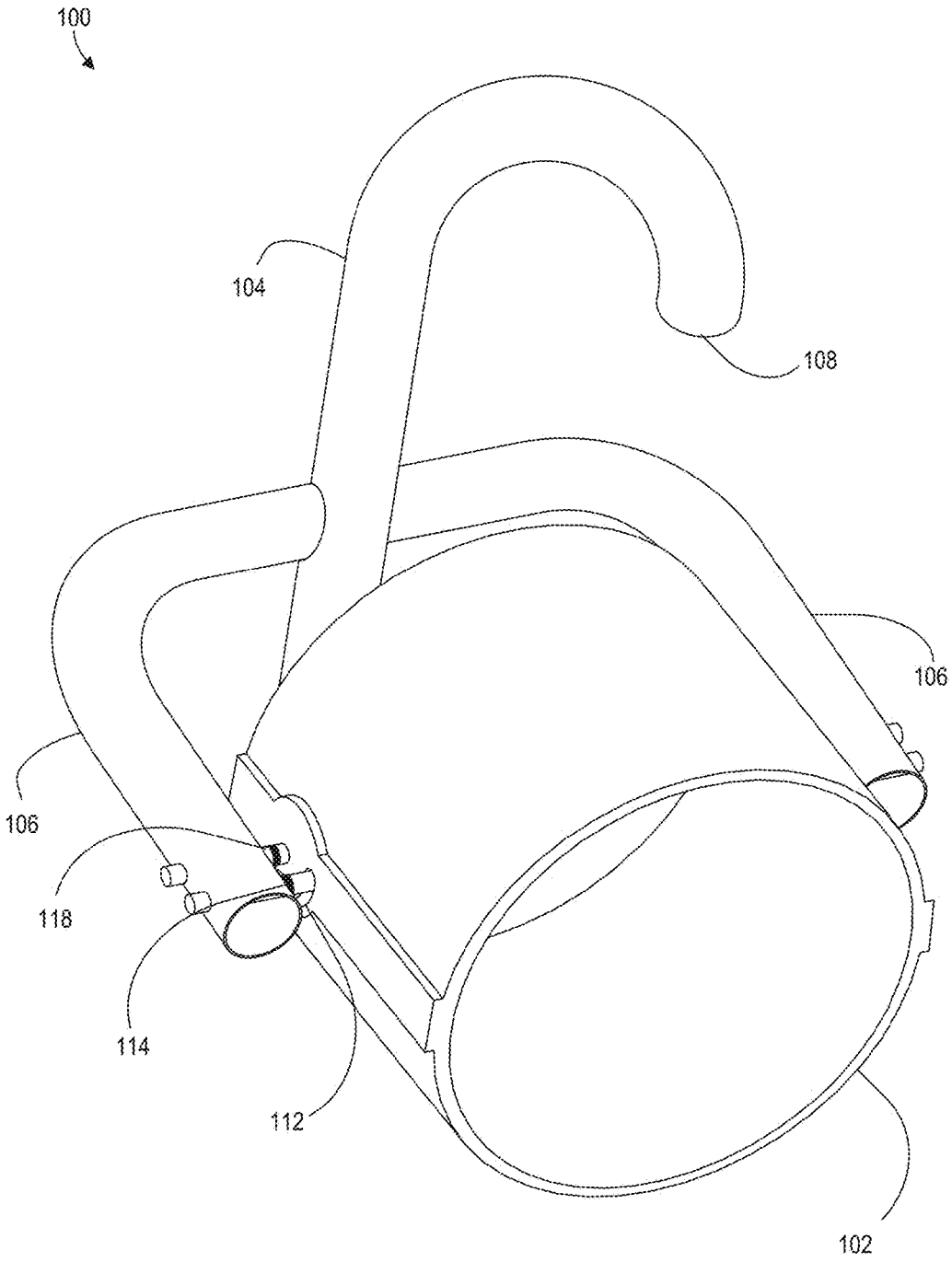
FIG. 3B is a partial perspective view of a water bucket game in a second position, in accordance with an example embodiment of the presently disclosed subject matter.

In some embodiments, the support member 106 may attach to the container 102, or the container 102 may attach to the support member 106, in a variety of different ways that allow for rotation of the container 102. As described above, the support member 106 may be attached to the container 102 by one or more pole members, such as one or more pins extending out of one or more arms of the support member 106. In some embodiments, the support member 106 may be joined to the container 102 by a ball-and-socket joint, pin joint, hinge, or other mechanical joint capable of enabling container 102 to rotate. In some embodiments, the container 102 and/or the support member 106 can have one or more retaining features that operate to limit the rotation of the container 102. For example, in some embodiments, as shown in FIG. 3A, the container 102 may have a retaining feature that is an arc-shaped slot or recess 112 having a first end and a second end. The support member 106 may include a retaining feature that is a stopper 114 that extends out of a portion of the support member 106. For example, a stopper 114 may extend out of an arm of the support member 106. According to some embodiments, the arc-shaped recess 112 may be configured to receive the stopper 114. According to some embodiments, the rotation of container 102 may be confined to a range of angles corresponding to the length of the arc-shaped recess 112. For example, as the container 102 rotates, the position of the stopper 114 within the arc-shaped recess 112 may change and the stopper 114 may prevent the bucket from rotating further in either direction by coming into contact with each respective end of the arc-shaped recess 112. As shown in FIG. 3A, in some embodiments, the container 102 may begin in a first position, where the container 102 is positioned in an upright orientation with the stopper 114 positioned at the first end of the recess 112. As shown in FIG. 3B, in some embodiments, the container 102 may rotate forwards to a second position where the stopper 114 is positioned at the second end of the recess 112. In some embodiments, the container 102 may be prevented from further rotation by the stopper 114 coming into contact with the edge of the recess 112 at the second end.

According to some embodiments, a retaining feature that may restrict the rotation of container 102 may be a string, rope, cord, or the like. For example, one end of a string may be attached to the container 102 and the other end of the string may be attached to the base member 104 or the support member 106. The string may have slack when the container 102 is in the beginning position, but as the container 102 begins to rotate the string may become taut, thereby restricting the rotation of the container 102. In some embodiments, a retaining feature may be a protruding member that extends from the side of the container 102 and which may catch on the support member 106 upon the container 102 rotating a predetermined distance. The interaction of the support member 106 and the protruding member may create a force preventing the further rotation of the container 102. Those of skill in the art will understand that, in various embodiments, the container 102 and the support member 106 may have a wide variety of different retaining features that can serve to restrict the rotation of the container 102 and those presented herein are merely examples of many possible designs.

The water game 100 may also include a biasing system that can operate to return the container 102 from the pouring position back to the beginning position. In some embodiments, the biasing system may automatically return the container 102 from the pouring position to the beginning position after the fluid 110 is poured out of the container 102. For example, as will be understood by one of skill in the art, in some embodiments, upon the container 102 pouring out the received fluid 110, the center of gravity of the now-emptied container may be such that it creates a torque sufficient to cause the now-emptied container 102 to rotate back to the beginning (or neutral) position. Put differently, the center of gravity of an empty container in the pouring position may be located above and to the rear of the axis of rotation, thus creating a torque sufficient to overcome the container's moment of inertia and causing the now-empty container 102 to rotate from the pouring position back to the beginning, neutral position.

In some embodiments, a biasing system may include a torque spring that can be attached to the container 102 on a first end, and to the support member 106 on a second end. According to some embodiments, the torque spring may become displaced or elongated when the container 102 rotates into the pouring state. As will be understood by those with skill in the art, when displaced, the torque spring may accumulate potential energy that converts into kinetic energy upon the release of fluid 110 from the container 102, thus causing the torque spring to contract, thus causing the container 102 to rotate back to an upright position and substantially returning it to the beginning position shown in FIG. 2A. In some embodiments, a biasing system may include a piston or a pump that can operate to rotate the container 102 from the pouring position back to the beginning position. According to some embodiments, a biasing system may involve weighting an end of the container 102. For example, a portion of the bucket that is lifted into the air upon entering the pouring position, such as, for example, a portion of the bottom or side of the container 102, may be configured to have a greater weight than the other portions of the container 102. In such a configuration, when substantially all of the liquid has been poured out of the container 102, the force of gravity acting upon the unequally distributed weight of the container 102 may cause the bucket to naturally rotate back to the beginning position. Those of skill in the art will understand that in various embodiments, a biasing system that can serve to return the container 102 from the pouring position back to the beginning position may take a wide variety of forms, and the biasing systems presented herein are merely examples of many possible designs.

Figure 4:
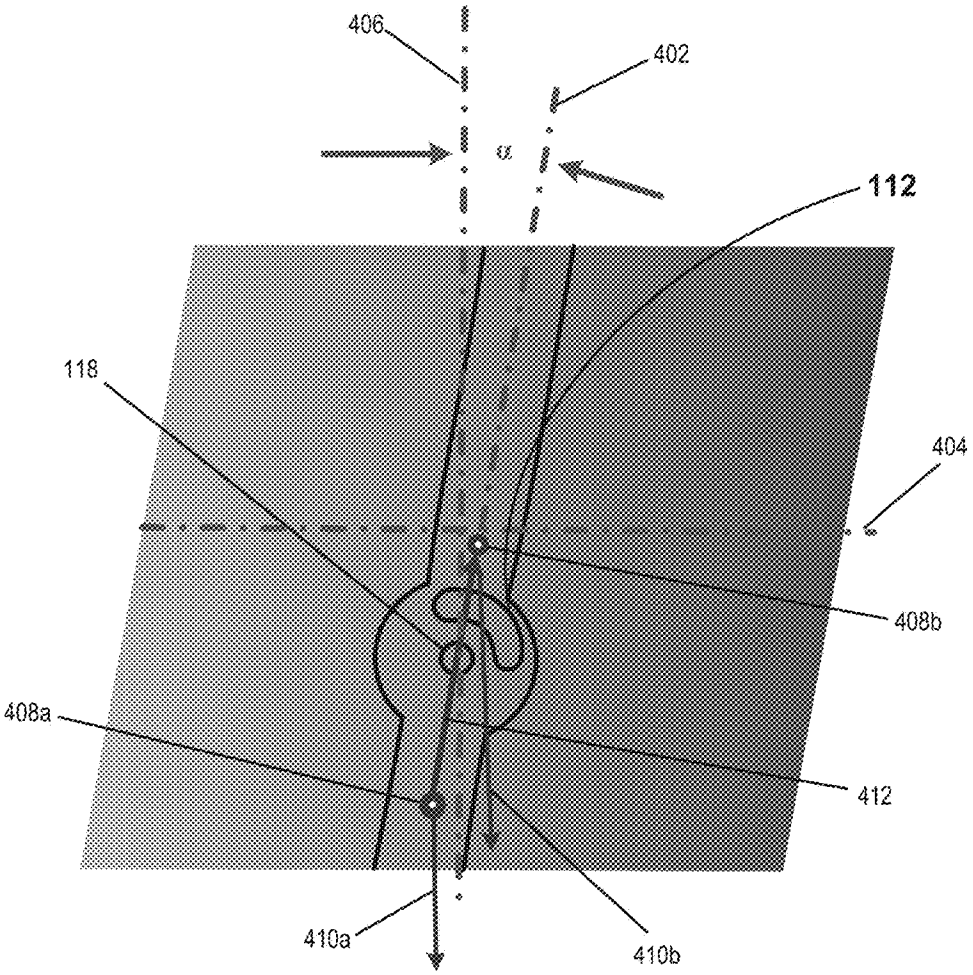
FIG. 4 is a partial side view of a bucket of a water bucket game, in accordance with an example embodiment of the presently disclosed subject matter.

FIG. 4 shows an example embodiment of a side view of container 102. As shown in FIG. 4, in some embodiments, the shape of container 102 may be configured such that it has the general shape of an angular cylinder. In other words, in some embodiments, the wall of the container 102 may extend away from a bottom surface of the container 102 at a non-right angle, as shown in FIG. 4. As shown in FIG. 4, the container 102 may have a vertical centerline 402 indicating the vertical center of mass of the container 102, and the container 102 may have a horizontal centerline 404 indicating the horizontal center of mass of the container 102. Further, FIG. 4 also shows a perpendicular line 406 indicating an axis that is perpendicular to the bottom surface of the container 102. In some embodiments, the angle between the perpendicular line 406 and the vertical centerline, angle $\alpha$, may be the angle at which the walls of the container 102 extend upwards, away from the bottom surface of the container 102, as described above. In some embodiments, the support member 106 may be attached to opposing sides of the container 102 at two attachment points 118. Accordingly, in some embodiments, the container 102 may rotate about an axis of rotation that extends between opposing sides of the container 102 at the attachment points 118. In some embodiments, the support member 106 may comprise substantially parallel arms that are positioned outside of opposing sides of the container 102. In some embodiments, each arm may include a pole member that is attached to the container 102, such that the container 102 may rotate about an axis of rotation formed between the two pole members.

As will be understood by those of the skill in the art, in some embodiments, the container 102, when empty, may have a center of gravity that is positioned along the vertical centerline 402. According to some embodiments, as the container 102 initially begins to receive fluid 110 from the base member 104, the partially filled container 102 may have a first center of gravity 408*a* associated with a first fill level. In some embodiments, the first center of gravity 408*a* may be positioned along the vertical centerline 402 close to the bottom surface of the container 102. For example, as shown in FIG. 4, at the first fill level, the fluid 110 may exert a first torque 410*a* downwards at the first center of gravity 408*a*. In some embodiments, the first torque 410*a* may be exerted near the center of the bottom surface of the container 102, however because the torque is applied below the axis of rotation, it may not affect a rotation of the container 102. According to some embodiments, as the container 102 continues to receive more fluid 110 from the support member 106 and begins to fill up, the first center of gravity 408*a* may shift along the vertical centerline 402 (i.e., along a path 412 shown in FIG. 4) until it reaches a second center of gravity 408*b* associated with a second fill level. In some embodiments, as shown in FIG. 4, at the second fill level, the fluid 110 may exert a second torque 410*b* at a location above and laterally offset from the axis of rotation between the attachment points 118. As will be understood by those having skill in the art, this torque 410*b* may be sufficient to overcome the moment of inertia of the container 102, causing the container 102 to rotate forwards from an upright position to a tilted position. As the fill level of the container 102 increases, the center of gravity of the fluid-filled container 102 will move further away from the axis of rotation, causing an increase in the tendency of the container 102 to rotate.

Thus, according to some embodiments, as fluid 110 begins to fill container 102, the center of gravity of the container 102 may move along the vertical centerline 402, gradually becoming higher and more laterally offset from the axis of rotation of the container 102. According to some embodiments, when the container 102 receives a predetermined amount of fluid 110, the torque caused by the shifted center of gravity of the container 102 may cause the container 102 to begin to rotate, causing the bucket game 100 to begin to change from the beginning state to the pouring state, as shown in FIGS. 2A-B. As the container 102 begins to rotate, it may continue to receive liquid from the second end 108 of the base member 104, which may cause the container 102 to accelerate the rotation that has been set into motion. As described above, in some embodiments, the container 102 may rotate until a retaining feature of the container 102 or support member 106 prevents further rotation.

While certain embodiments of the disclosed technology have been described in connection with what is presently considered to be the most practical embodiments, it is to be understood that the disclosed technology is not to be limited to the disclosed embodiments, but on the contrary, is intended to cover various modifications and equivalent arrangements included within the scope of the appended claims. Although specific terms are employed herein, they are used in a generic and descriptive sense only and not for purposes of limitation.

This written description uses examples to disclose certain embodiments of the disclosed technology, including the best mode, and also to enable any person skilled in the art to practice certain embodiments of the disclosed technology, including making and using any devices or systems and performing any incorporated methods. The patentable scope of certain embodiments of the disclosed technology is defined in the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A device comprising:

a base member having a first end for receiving a fluid and a second end for expelling the fluid;

a support member attached substantially horizontally to the base member, the support member comprising a stopper member; and a container rotatably attached to the support member, the container comprising a recess having a first end and a second end, the container configured to rotate between a first position, in which the container is positioned to receive the fluid expelled from the second end of the base member, and a second position, in which the container is positioned to pour out the received fluid, the container being configured to automatically return from the second position to the first position after pouring out the received fluid, and wherein the stopper member extends toward the container, and the recess is configured to receive the stopper member.

2. The device of claim 1, the support member comprising two substantially parallel arms positioned on opposing sides of the container.

3. The device of claim 2, each of the two substantially parallel arms comprising a pole member configured to attach to opposing sides of the container to create an axis of rotation between the two pole members.

4. The device of claim 3, the axis of rotation located relative to a center of mass of the container that is associated with a predetermined fill level, such that when the received fluid reaches the predetermined fill level, the container overcomes the container's moment of inertia and begins to rotate from the first position toward the second position.

5. The device of claim 1, wherein when the container is at the first position, the stopper is positioned at the first end of the recess, and wherein when the container is at the second position, the stopper is positioned at the second end of the recess, the stopper abutting the wall of the second end of the recess and preventing the container from further rotating in a direction moving from the first position to the second position.

6. The device of claim 5, wherein the container comprises a bottom surface and a vertical surface extending upwards from the bottom surface, the bottom surface and vertical surface forming a receptacle with an open mouth that is capable of receiving and holding a fluid when the container is in an upright position.

7. The device of claim 6, where the vertical surface extends away from the bottom surface at a non-right angle such that the center of mass of the bucket when empty is laterally offset from the center of the bottom surface.

8. The device of claim 7, wherein the container is configured to automatically return from the second position to the first position after pouring out the received fluid.

9. The device of claim 1, wherein the first end of the base member is configured to couple with an end of a hose.

10. The system of claim 9, wherein a portion of the base member is configured to attach to a wall of a swimming pool.

11. A system comprising:

a base member having a first end for receiving a fluid and a second end for expelling the fluid;

a support member attached substantially horizontally to the base member, the support member comprising a stopper member;

a container rotatably attached to the support member, the container comprising a recess having a first end and a second end, the container configured to rotate between a first position, in which the container is positioned to receive the fluid expelled from the second end of the base member, and a second position, in which the container is positioned to pour out the received fluid, the container being configured to automatically return from the second position to the first position after pouring out the received fluid; and a swimming pool positioned beneath the container to receive the received fluid when poured out of the container, wherein the stopper member extends toward the container, and the recess is configured to receive the stopper member.

12. The system of claim 11, the support member comprising two substantially parallel arms positioned on opposing sides of the container.

13. The system of claim 12, each of the two substantially parallel arms comprising a pole member configured to attach to opposing sides of the container to create an axis of rotation between the two pole members.

14. The system of claim 13, the axis of rotation located relative to a center of mass of the container that is associated with a predetermined fill level, such that when the received fluid reaches the predetermined fill level, the container overcomes the container's moment of inertia and begins to rotate from the first position toward the second position.

15. The system of claim 11, wherein when the container is at the first position, the stopper is positioned at the first end of the recess, and wherein when the container is at the second position, the stopper is positioned at the second end of the recess, the stopper abutting the wall of the second end of the recess and preventing the container from further rotating in a direction moving from the first position to the second position.

16. The system of claim 15, wherein the container comprises a bottom surface and a vertical surface extending upwards from the bottom surface, the bottom surface and vertical surface forming a receptacle with an open mouth that is capable of receiving and holding a fluid when the container is in an upright position.

17. The system of claim 16, where the vertical surface extends away from the bottom surface at a non-right such that the center of mass of the bucket when empty is laterally offset from the center of the bottom surface.

18. The system of claim 17, wherein the container is configured to automatically return from the second position to the first position after pouring out the received fluid into the swimming pool.

* * * * *